United States Patent [19]

Unger

[11] 4,105,200

[45] Aug. 8, 1978

[54] HAND AND FINGER EXERCISE DEVICE

[76] Inventor: Ann Unger, 140 Cabrini Blvd., New York, N.Y. 10033

[21] Appl. No.: 775,716

[22] Filed: Mar. 9, 1977

[51] Int. Cl.[2] ..... A63B 21/30

[52] U.S. Cl. ..... 272/67; 272/137; 272/142; 272/143; 272/68

[58] Field of Search ..... 272/135, 142, 67, 68, 272/93, 137, 143; 401/8; 280/11.37 D, 11.37 H, 11.37 L; 273/167, 75, 145 A; 128/25 R, 26

[56] References Cited

U.S. PATENT DOCUMENTS

| | | | |
|---|---|---|---|
| 1,554,633 | 9/1925 | Ingram | 273/145 A |
| 2,753,186 | 7/1956 | Kleinman | 273/75 |

FOREIGN PATENT DOCUMENTS

| | | | |
|---|---|---|---|
| 27,934 of | 1904 | United Kingdom | 272/68 |

*Primary Examiner*—William R. Browne

*Attorney, Agent, or Firm*—Gottlieb, Rackman & Reisman

[57] ABSTRACT

There is disclosed a hand and finger exercise device particularly useful in combatting various arm and hand ailments, such as "tennis wrist" and "tennis elbow". The device includes a main cylindrical member, substantially of the diameter of a tennis racquet handle, adapted to be grasped in the palm of a user. Two elasticized straps run the full axial length of the member, at the side wall of the cylinder. One of these straps fits over the four fingers of the user's hand, adjacent the knuckles thereof, for maintaining the exercise device in place. The second strap fits over the four fingers of the user's hand, adjacent the finger tips. A third, thumb-receiving strap, which also runs along the axial length of the member but which extends only partially down the side wall, receives the thumb of the user. The device may be used with either of the user's hands, with the user squeezing the cylindrical member and thereafter flexing his fingers and thumb outwardly, against the forces presented by the straps.

5 Claims, 4 Drawing Figures

FIG. 1
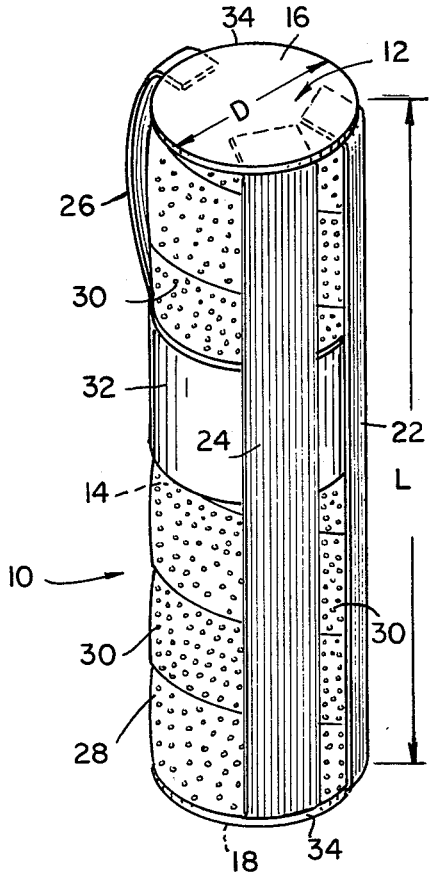
FIG. 3
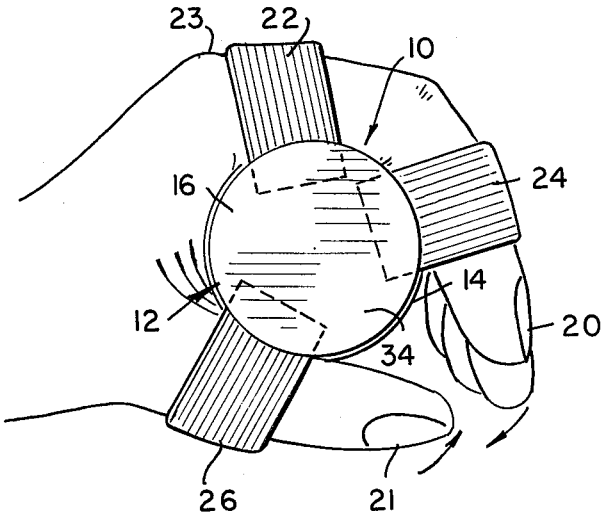
FIG. 4
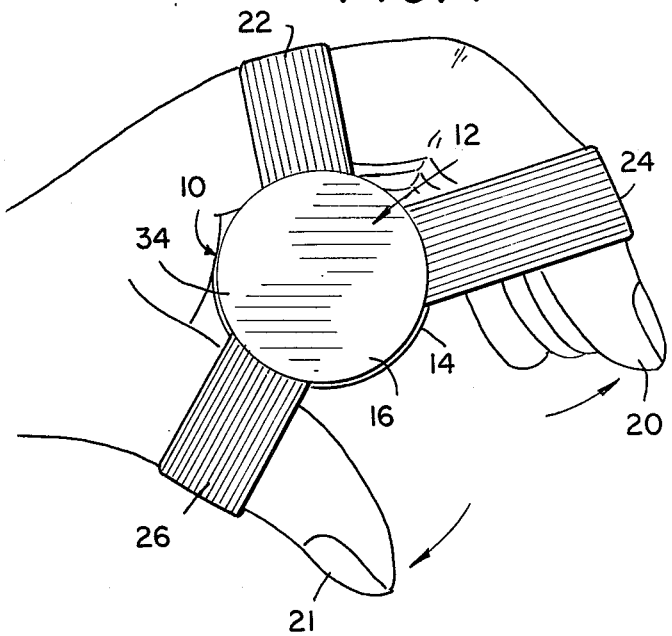
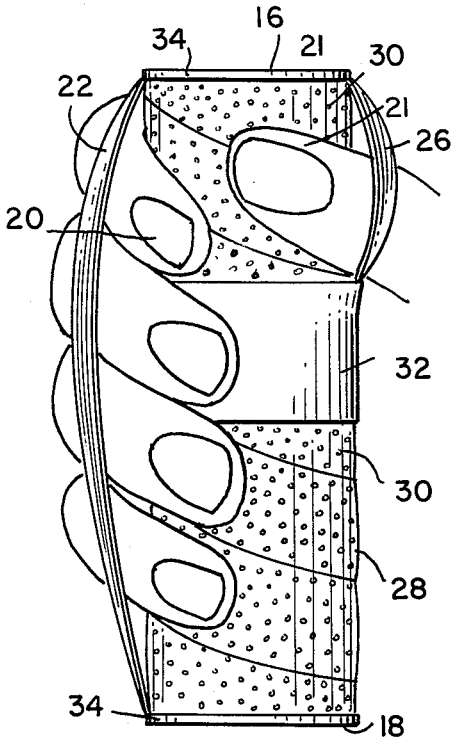
FIG. 2

HAND AND FINGER EXERCISE DEVICE

This invention relates generally to exercise devices and, more particularly, to a self-retained hand and finger exercise device.

Over the past several years, there has been a tremendous increase, in the United States and elsewhere, in tennis, golf and other leisure and sporting activities which utilize equipment which is grasped in the user's hand, and swung back and forth. There has also been a corresponding increase in various arm and hand ailments, commonly called "tennis wrist" and "tennis elbow" ailments, associated with the increase in these leisure and sporting activities. Thus, there exists a need in the art to provide a hand and finger exercise device which may be utilized to strengthen fingers, hands, wrists and arms in order to remedy the "tennis elbow" type ailments.

Hand and finger exercising devices are well known in the art, as indicated by U.S. Pat. Nos. 1,126,938, 2,634,976, 3,347,547, 3,496,573, 3,542,363 and 3,612,521. However, these prior art devices have several drawbacks. For example, either they are not the type of device which would be used to strengthen the body in a way which would prevent "tennis elbow" type ailments, or they are cumbersome to use, or they may not be used by both the right and left hands of a user, or they are expensive to manufacture.

It is thus a broad object of the present invention to provide a hand and finger exercising device which overcomes the difficulties of hand and finger exercise devices of the prior art.

A more specific object of the invention is to provide a hand and finger exercise device which is particularly useful in preventing and/or treating "tennis elbow" and similar arm and hand ailments.

Yet another object of the present invention is to provide a hand and finger exercise device which is simple in construction, thereby decreasing manufacturing costs and further making the device easy to use.

Yet another object of the present invention is to provide a hand and finger exercise device which may be used either by the right or left hand of a user.

Still another object of the present invention is to provide a hand and finger exercise device which is self-retained, so that the device does not slip off and fall from a user's hand, when the device is being used.

These and other objects of the present invention are obtained by providing a self-retained hand and finger exercise device which is adapted to be used with either the right hand or the left hand of a user. The device includes a generally cylindrical main member, which is adapted to be grasped in the palm of a user, and which has a diameter substantially that of a tennis racquet handle. A hand-retaining strap is disposed along the full axial length of the member, at the side wall of the cylinder, for fitting over the four fingers of the user's hand adjacent the user's knuckles. A second substantially identical flexing strap is disposed approximately 120° from the hand-retaining strap and this strap fits over the four fingers of the user's hand, adjacent the finger tips. A third thumb-receiving strap, disposed 120° from the first two straps, extends partially along the axial length of the cylinder side wall, and fits over the thumb of a user.

To use the device, the user slips his fingers through the first and second straps and slips his thumb through the thumb-receiving strap, so that the cylindrical member is in the palm of the user. The user's hand, fingers, wrist and arm are exercised, by the user squeezing the cylindrical member, releasing the grip on the member, and flexing the fingers and thumb outwardly against the action of the straps.

The above brief description of the present invention will be more readily appreciated by reference to the following detailed description of a presently preferred, but nonetheless illustrative embodiment of the invention, when taken in conjunction with the following drawings, wherein:

FIG. 1 is a front, perspective view showing a hand and finger exercise device according to the present invention;

FIG. 2 is a side, elevation view showing the exercise device used with the right hand of a user;

FIG. 3 is a top, plan view showing the exercise device used with the left hand of a user; and FIG. 4 is a view similar to that of FIG. 3, but showing the user flexing the thumb and fingers outwardly and against the action of the elasticized straps.

Referring to the drawings and, more particularly, to FIG. 1 thereof, a hand and finger exercise device, according to a preferred embodiment of the present invention, is generally designated 10. The exercise device includes a generally cylindrical main member 12 which is adapted to be held in the palm of user's hand. The member 12 has a cylindrical side wall 14, and top and bottom walls 16 and 18. The member may be solid or hollow in nature, and fabricated from wood, plastic or a similar resilient material which is adapted to withstand the squeezing pressure exerted on the side wall.

The cylindrical member has a diameter, D, substantially equal to the diameter of a conventional tennis racquet handle and sufficient for the fingers and thumb to hold the member about its circumference without overlap of the fingers and thumb, and an axial length, L, sufficient for all four fingers 20 of the hand of a user to fit along the length of the member, as indicated in FIG. 2. By way of example only, the diameter, D, of the cylindrical member may be approximately 1 to 2 inches, and the length, L, may be approximately 3 to 6 inches.

A hand-retaining strap 22, preferably of an elastic or similar type of material, is connected between the top wall 16 and the bottom wall 18 of the cylindrical member, with this strap disposed axially along the length L of side wall 14. The hand-retaining strap 22 may be fastened to the top and bottom walls by glue, nails or by any other appropriate means sufficient to insure that the ends of the retaining strap will remain fixed to the member.

A substantially identical flexing strap 24 is similarly connected between the top and bottom walls 16, 18 of the cylindrical member. The flexing strap, which is also formed of an elastic or other type of material, also extends the full axial length L of the cylindrical member, along the side wall 14. As indicated in FIGS. 3 and 4, the flexing strap 24 is disposed approximately 120° away from the hand-retaining strap 22.

Device 10 also includes a third, elastic thumb-receiving strap 26 which is adapted to receive the thumb 21 of either the user's right or left hand, depending on which hand grasps the cylindrical member 12. The thumb-receiving strap is connected to top wall 16, but this strap is not fastened to the bottom wall 18. Rather, and as indicated most clearly in FIG. 2, the thumb-receiving strap is fastened, by glue, nails or the like (not shown), to the side wall 14, approximately midway between the top wall 16 and the bottom wall 18. Strap 26 is disposed approximately 120° from each of the straps 22, 24.

As indicated in FIGS. 1 and 2, leather or rubber strips 28, of a type normally wound around tennis racquet and golf handles, is also wound around the side wall 14 of the cylindrical member 12. The strips prevent the user's fingers 20 and thumb 21 from slipping off the side wall, when the exercise device 10 is being used. The strips may include a series of perforations 30 provided for purposes of ventilation and/or traction. A rubber or leather band 32 may also be wound over the strips 28, in order to help maintain the thumb-receiving strap 26 in place, and in order to cover the nails or similar means utilized to secure the end of the thumb-receiving strap in place to side wall 14. Similarly, round disc-like caps 34, formed of leather or rubber, are glued or otherwise secured over the top and bottom walls 16 and 18 of the cylindrical member, in order to assist in keeping the various straps in place, as well as for aesthetic purposes in covering nails or the like used to secure the straps to member 12.

As indicated heretofore, the hand and finger exercise device 10 is particularly useful in exercising and strengthening the fingers, hand, wrists and arms of a user to prevent or alleviate various arm and hand ailments, such as "tennis elbow". The device is self-retaining when in use, and may be used by either the left or the right hand of a user.

FIGS. 3 and 4 show the manner in which device 10 may be utilized. As indicated in these figures (which show the device being used with the left hand of a user), the user's left thumb 21 is inserted through the thumb-receiving strap 26 and the four fingers 20 of the user's left hand are inserted first through the hand-retaining strap 22 and then through the flexing strap 24. The hand-retaining strap 22 is adapted to fit over the four fingers of the user's hand, adjacent the knuckles 23 of the hand, as shown in FIG. 3. However, it will be appreciated that the strap 22 may fit on top of the knuckles, over the back palm of the hand or even more towards the finger tips, depending on the size of the user's hand, as well as depending on the manner in which the user "stretches" and then releases the strap 22 over his hand.

In a similar manner, the flexing strap 24 is adapted to be disposed adjacent the tips of the four fingers 20, with this strap passing adjacent the finger tips, for example, the strap 24 may pass over the finger joint closest to the finger tips. Once again, the actual placement of the flexing strap 24 depends on the size of the user's hand as well on where the user actually places the strip over the fingers.

The hand and finger exercise device 10 is typically used whereby the user exerts squeezing pressure on the side wall 14 of the cylindrical main member 12. This type pressure is indicated in FIG. 3, wherein the arrows show the user tightening his four fingers 20 and thumb 21 and squeezing the side wall 14. After this has been done for a predetermined period of time, the user stops exerting pressure on the cylindrical member 12 and "opens" his hand, against the action of the flexing strap 24 and the thumb-receiving strap 26. As indicated in FIG. 4, the user has partially opened his palm and has moved the fingers 20 and the thumb 21 in the direction of the arrows. The fingers are flexed outwardly against the elastic action of the flexing strap 24 and the thumb also flexes outwardly, against the elastic action of the thumb-receiving strap 26. It will be appreciated that during this type of movement of the fingers 20 and the thumb 21, the exercise device 10 is retained in place in the user's hand by the action of the retaining-strap 22, which continues to exert pressure against the knuckles of the user.

The opening and closing of the hand is repeated, with the side wall 14 of member 12 alternately being squeezed and released and with the fingers and thumb closing and then flexing outwardly against the action of the straps 24 and 26. It is believed that this type of movement of the user's hand builds up not only the fingers, but also the wrist and arm of the user and is the type of action which would tend to prevent or reduce "tennis elbow" type ailments.

Device 10 may be used with either the right or left hand of the user. In FIG. 2, the exercise device is being used with the right hand; the fingers flex outwardly against the action of strap 22 and the device is maintained in place by the action of strap 24.

The strips 28 not only prevent slippage of the fingers, thumb and hand, but they also assist in ventilation and present a tennis "feel" for the device, i.e., the user feels that he is grasping a tennis racquet handle which provides added enjoyment in using the device, particularly to avid tennis players.

Although the invention has been described with reference to a particular embodiment, it is to be understood that this embodiment is merely illustrative of the application of the principles of the invention. For example, the size of the cylindrical member 12, both in length and diameter, may be varied and, if desired, the strips covering the core 12 may be eliminated and/or changed. Further, although the straps 22 and 24 of the illustrative embodiment have been described as being identical, it will be appreciated that the hand-retaining strap 22 and the flexing strap 24 may have different elastic properties. Similarly, the device 10 may be formed so that the thumb-receiving strap 26 is merely "tacked" down, midway along the side wall 14 of the cylindrical member, with the end of the thumb-receiving strap then continuing and being fastened to the bottom wall 18 of the member. In this manner, two thumb-receiving straps will be provided, and this may be particularly useful when the straps 22 and 24 have different elastic properties and when the device is to be used with both of the user's hands. To use the device in one and then the other hand, the device is "flipped" over, so that the thumb fits through the other thumb-receiving strap. In this manner, the device will always have the same hand-retaining strap and the same flexing strap, regardless of whether the device is used by the right or the left hand. Still further, the member 12 may be formed to include finger indentations along the side wall 14, which indentations would be particularly useful in receiving the four fingers which are wrapped around the member. Thus, it is to be understood that numerous modifications may be made in the illustrative embodiment of the invention and other arrangements may be devised, without departing from the spirit and scope of the invention, as set forth in the appended claims.

What is claimed is:

1. A self-retained hand and finger exercise device adapted to be used with either the right hand or the left hand of a user and comprising a generally cylindrical main member having a side wall adapted to be grasped in the palm of a user, an elastic hand-retaining strap disposed axially and at the side wall of the member for fitting over the four fingers of the user's hand adjacent the knuckles thereof and for maintaining the member in the user's palm as the user flexes his thumb and four fingers away from the side wall, an elastic thumb receiving strap disposed axially and at the side wall of the member for receiving the thumb of the user's hand, said thumb receiving strap exerting pressure on the thumb of the user as the user flexes his thumb away from the side wall and against the elastic action of the thumb receiving strap, and an elastic flexing strap disposed axially and at the side wall of the member for fitting over the four fingers of the user's hand adjacent the fingertips thereof, said flexing strap exerting pressure on the four fingers of the user as the user flexes these fingers outwardly away from the side wall and against the elastic action of the flexing strap, said straps enabling all five fingers of the user's hand to flex outwardly while at the same time retaining the member in the user's palm.

2. A self-retained hand and finger exercise device according to claim 1, wherein the hand-retaining strap and the flexing strap each extend along the entire axial length of the member.

3. A self-retained hand and finger exercise device according to claim 2 wherein the thumb-receiving strap extends approximately half-way down the axial of the member.

4. A self-retained hand and finger exercise device according to claim 1 wherein the hand-retaining strap, the thumb-receiving strap and the flexing strap are disposed approximately 120° from each other.

5. A self-retained hand and finger exercise device according to claim 1 further including stripping wound over the side wall of the member for preventing slippage of the user's hand.

* * * * *